United States Patent [19]

Dodemont et al.

[11] 4,239,273

[45] Dec. 16, 1980

[54] DEVICE FOR THE ROTARY ASSEMBLY OF A MEMBER CONTROLLED BY PRESSURIZED FLUID

[75] Inventors: Gerard P. Dodemont, Crepy en Valois; Christian H. Viallefont, Meaux, both of France

[73] Assignee: Poclain, France

[21] Appl. No.: 964,719

[22] Filed: Nov. 29, 1978

[30] Foreign Application Priority Data

Dec. 6, 1977 [FR] France ..... 77 36747

[51] Int. Cl.[3] ..... B66C 1/00

[52] U.S. Cl. ..... 294/88; 37/186

[58] Field of Search ..... 294/86 R, 88, 106, 118, 294/70; 37/183 R, 184, 185, 186, 187, 188; 414/739, 735, 729, 651

[56] References Cited

U.S. PATENT DOCUMENTS

| | | | |
|---|---|---|---|
| 3,877,743 | 4/1975 | Johnson | 294/88 |
| 3,914,886 | 10/1975 | Berg et al. | 37/186 |
| 4,099,762 | 7/1978 | Hultdin et al. | 294/88 |

FOREIGN PATENT DOCUMENTS

| | | |
|---|---|---|
| 551737 | 10/1956 | Belgium . |
| 1339635 | 9/1963 | France . |
| 1010086 | 11/1965 | United Kingdom . |

*Primary Examiner*—James B. Marbert

*Attorney, Agent, or Firm*—Lewis H. Eslinger

[57] ABSTRACT

The invention relates to a device for the rotary assembly of a member controlled by pressurized fluid, comprising a body presenting first and second shoulders opposite which are disposed first and second shoulders, with which is provided the member comprising an inner pipe opening into a groove disposed between this member and the body into which a main conduit, made in the body, opens out, while an inner conduit, made in the body, opens into the first shoulder of the body and is connected to the conduit, the pressure of the fluid contained in the conduit being capable of having such a value that the resultant thrust which is exerted on the first shoulder of the member has for its effect to cause the second shoulders to abut firmly on one another, effecting the locking of elements. One application of the invention is the production of a drag bucket with monitored rotation.

11 Claims, 7 Drawing Figures

15
13
14a
59
58
61
62
45
60
64
63
36
12
34
28
37
47
39
51
41
49
50
43
52
40
48
27
44
30
42
7
20
21
52a
65
53
66
54
56
67
69
57
68
55

15
13
14a
59
58
61
70
45
60
62
64
63
12
73
71
39
47a
41
52a
49a
50a
51a
43
40
48a
72
76
75
42
44
74
7
21
20
52a
65
53
66
54
56
67
69
57
68
55

DEVICE FOR THE ROTARY ASSEMBLY OF A MEMBER CONTROLLED BY PRESSURIZED FLUID

The invention was firstly devised to propose a novel type of orientable grab bucket, but has applications other than solely the production of grab buckets.

In order to explain the origins of the invention, the example of grab buckets will be given hereinafter, bearing in mind the wider application of this invention.

In the field of grab buckets, buckets exist at present which may pivot about a vertical axis passing through their suspension device.

These buckets either rotate freely or do not rotate freely. The free-rotation buckets may pivot without it being possible to monitor or control a preferred orientation thereof. On the contrary, the buckets which do not rotate freely have a device for monitoring their orientation and sometimes even a control device. The monitoring consists in a locking of the rotation for certain orientations of the bucket, the control consisting in a possibility of pivoting the bucket to dispose it in any desired orientation.

The most simple devices are the monitoring devices, although the known monitoring devices are in fact complicated, heavy and expensive.

It is an object of the invention to propose a novel device for monitoring orientation, which is of course applicable to pivoting drag buckets, but also more generally applicable to tools controlled by pressurised fluid.

The invention therefore relates to a device for the rotary assembly of a tool member controlled by pressurised fluid, such as the suspension device of a hydraulically controlled drag bucket, comprising a body presenting at least first and second shoulders opposite which are respectively disposed first and second shoulders, with which said rotary member is provided so as to produce, on the one hand, said rotary assembly, on the other hand, the maintenance in axial position of the rotary member with respect to the body of the device, said rotary member further comprising at least one inner pipe for conveying the fluid controlling the tool, opening into a circular groove which is disposed between this member and the body of the device and into which a main, so-called supply conduit, made in said body, permanently opens. At least one inner conduit, made in one of the two elements—body of the device and rotary member—opens into the first shoulder of said element in which said inner conduit is made and is connected to said main conduit.

In this device, the pressure of the fluid contained in the main conduit is capable of having such a value that the resultant thrust which is exerted on the first shoulder of the other element—rotary member and body of the device—has for its effect to cause the second respective shoulders of the two elements to abut firmly on each other, effecting the locking of these shoulders in relative rotation and consequently the locking of the elements which are provided with said shoulders.

When, in manner known per se, the rotary member comprises two inner pipes, when two circular grooves are disposed between the member and the body of the device and two main conduits, one constituting a supply conduit for pressurised fluid, the other an exhaust conduit for fluid without pressure, and, inversely, selectively, are made in said body and permanently open, one, into one of the two grooves, the other, into the other groove, the inner conduit advantageously comprises three portions, of which the first portion connects a first of the two main conduits to a first of the two inlet connections of a a shuttle valve, the second portion connects the second main conduit to the second of the two inlet connections of said shuttle valve, and the third portion connects said shoulder to the outlet connection of the shuttle valve.

The following arrangements are furthermore preferably adopted:

the two shoulders of the rotary member are constituted by the two faces of a flange distinct from said rotary member and removably fixed on one end of this member;

one of the two faces of the flange is in contact with one of the end transverse faces of the rotary member;

one of the shoulders of the body is constituted by the inner face of an end piece of said body, distinct from the remaining part of the body and removably fixed on said remaining part;

at least one selective obturation member is disposed on the inner conduit, being mounted either in the body or in the rotary member, possibly in retractable and even removable manner.

The invention will be more readily understood on reading the following description with reference to the accompanying drawings, in which.

Figure 1:
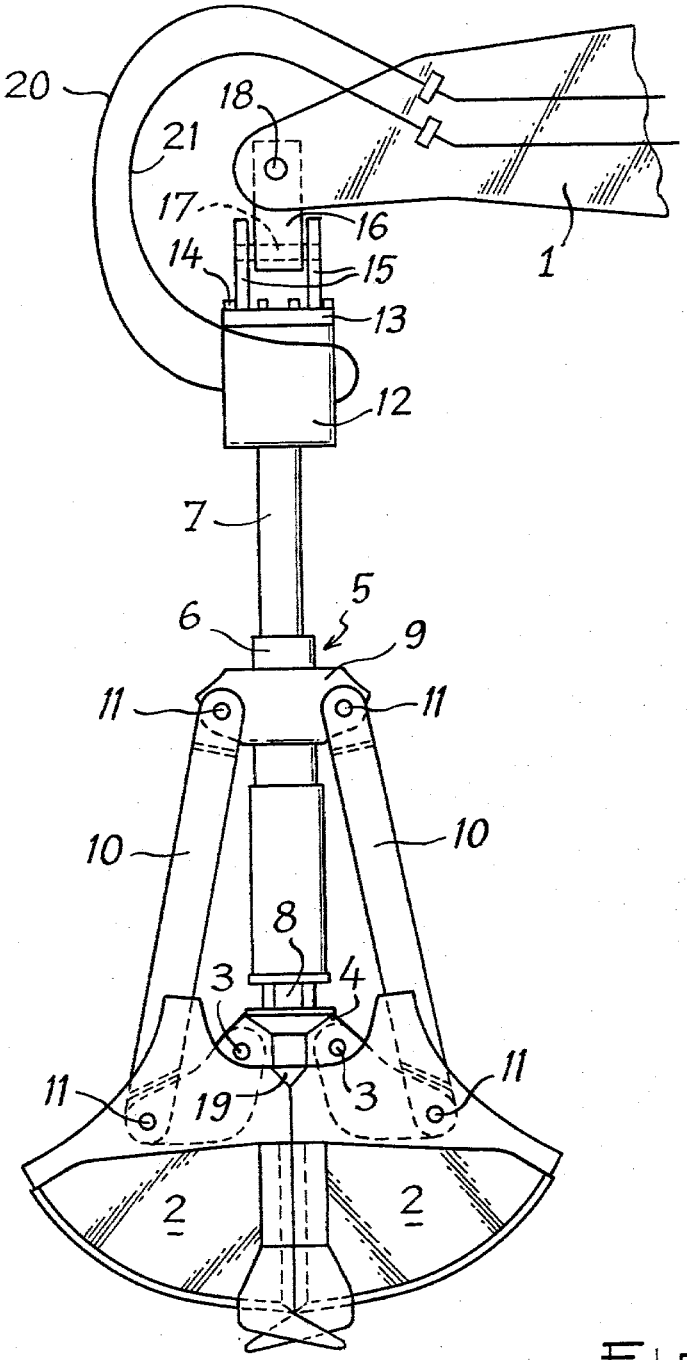
FIG. 1 is an elevational view of a grab bucket employing a device according to the invention.

Referring now to the drawings, the drag bucket of FIG. 1 is suspended from the end of the balance beam 1 of a hydraulic shovel.

It is constituted by:

two shells 2 pivoted about parallel horizontal spindles 3 on a transverse bar 4, a control jack 5 comprising a cylinder 6, with respect to which are slidably mounted upper and lower piston rods 7 and 8, respectively, a collar 9 fixed to the cylinder 6, two control arms 10 each pivoted on said collar 9 and on a shell 2 about spindles 11, a casing 12, fixed in translation with respect to the upper piston rod 7, and a flange 13 fixed on the upper section of the casing 12, by screws 14, supporting a fork joint 15 pivoted on an arm 16 about a horizontal spindle 17, whilst said arm 16 is itself pivoted on the balance beam 1 about a horizontal spindle 18 at right angles to spindle 17.

The lower end of the lower piston rod 8 is further fixed (19) to the transverse bar 4. Finally, two conduits 20 and 21 are connected to the casing 12 and convey the fluid supplying one of the chambers of the jack 5 and the fluid delivered from the other chamber, respectively, and inversely.

Figure 2:
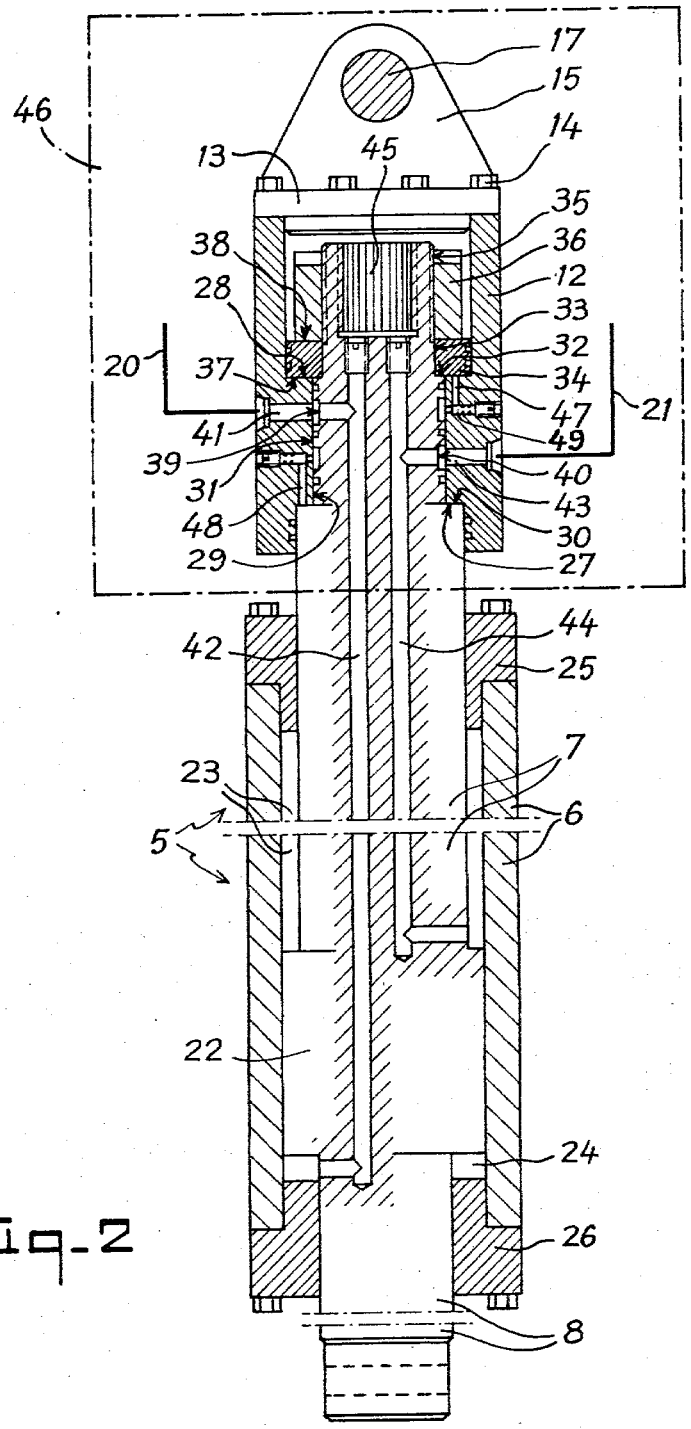
FIG. 2 is a section through the hydraulic mechanism of the bucket of FIG. 1.

FIG. 2 shows all the control mechanism of the bucket of FIG. 1. The piston 22 of the jack 5 is mounted to slide in the cylinder 6 and defines two distinct and separate chambers 23 and 24. The piston rods 7 and 8 are fast therewith and pass hermetically through the upper and lower end plates 25 and 26, respectively, of the cylinder 6.

The assembly of the casing 12 on the upper end of the upper piston rod 7 is such that this casing is mounted to rotate whilst being immobilised in translation with respect to this piston rod 7. To this end, the casing 12 comprises two shoulders 27, 28 oriented in opposite directions between which a cylindrical bore 29 is made, whilst the upper end of the upper piston rod 7 is provided successively, in the direction of its end, with a shoulder 30 corresponding to the shoulder 27, a cylindrical portion 31 corresponding to the bore 29 and contained in this bore, a shoulder 32, oriented in the same direction as the shoulder 30 of the rod and as the shoulder 28 of the casing, and disposed substantially at the same level as the shoulder 28, another cylindrical portion 33 about which is disposed a ring 34 and an outer thread 35 on which a nut 36 is screwed. The lower transverse face 37 of the ring 34 is disposed opposite the shoulders 28 and 32, in abutment on this latter shoulder 32 by the effect of tightening of the nut 36 on the upper face 38 of the ring 34.

It will be noted that two circular grooves 39, 40 are made on the periphery of the cylindrical portion 31 of the rod 7 disposed opposite the bore 29 and communicate permanently, as follows:

the groove 39 on the one hand communicates with conduit 20, by means of a conduit 41 made in the wall of the casing 12, on the other hand, with the lower chamber 24 of the jack 5, by means of a conduit 42 drilled in the upper piston rod 7 and in the piston 22 and opening out below said piston, near its lower face, the groove 40 on the one hand communicates with the conduit 21, by means of a conduit 43 made in the wall of the casing 12, on the other hand with the upper chamber 23 of the jack 5, by means of a conduit 44 drilled in the upper piston rod 7 and opening out above the piston 22, near its upper face.

Furthermore, the upper end of the upper piston rod 7 comprises a central recess of which the periphery is provided with corrugations 45, without use in the mechanism of FIG. 2.

Figure 3:
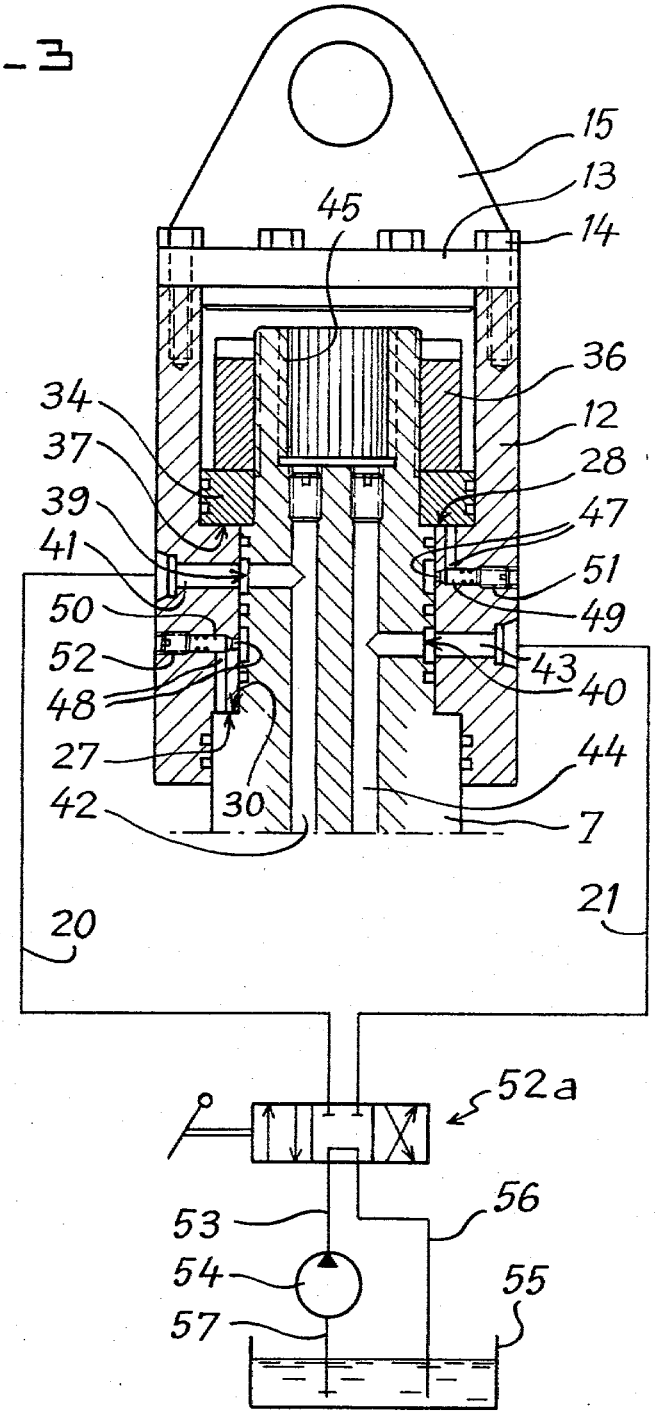
FIG. 3 is an enlarged view of a detail of the mechanism shown in FIG. 2, in a first phase of operation.

This mechanism comprises a complementary arrangement which is seen more clearly in FIG. 3 which is an enlarged view of the upper part of FIG. 2 contained in the square 46.

In this FIG. 3, it will be noted that a conduit 47 connects the groove 39 to the shoulder 28 into which it opens out, and is drilled in the casing 12, in the same way as a conduit 48 connects the groove 40 to the shoulder 27, into which it opens out whilst being itself drilled in the casing 12. Obturators 49, 50, whose positions are adjustable, are disposed in the conduits 47, 48 respectively, and, in the configuration of FIG. 3, effectively obturate said conduits. The adjustment of the position of the obturators 49, 50 is obtained by screwing (51, 52) of said obturators in the wall of the casing 12.

It will be noted that, in known manner, the conduits 20, 21 are connected to a three-way fluid distributor 52*a* which is further connected to the delivery conduit 53 of a pump 54 and to a tank 55 by a conduit 56. The pump 54 is itself connected to the tank 55 by its suction conduit 57.

The three positions of the distributor 52*a* correspond as follows:

the first position corresponds to the placing in communication of conduits 20 and 53 and of conduits 21 and 56;

the second position corresponds to the placing in communication of conduits 53 and 56 and to the obturation of conduits 20 and 21, and the third position corresponds to the placing in communication of conduits 20 and 56 and of conduits 21 and 53.

Figure 4:
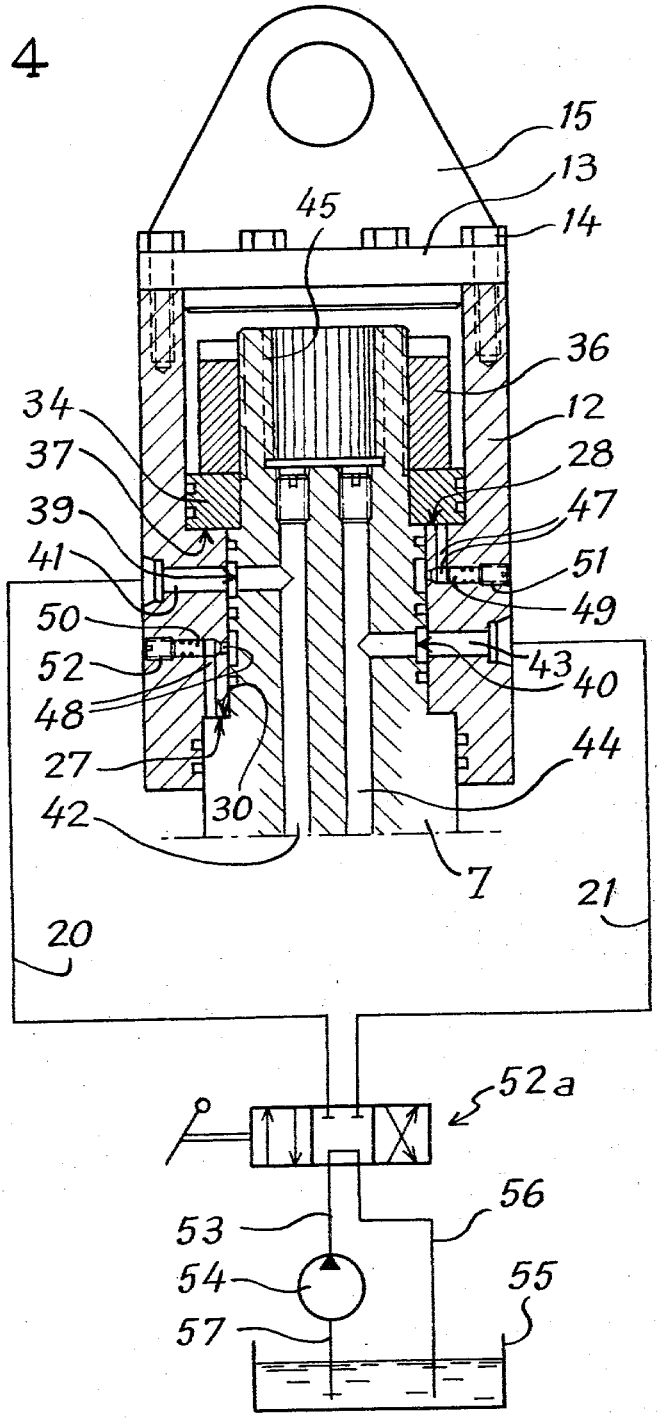
FIG. 4 is an enlarged view similar to that of FIG. 3, of the same mechanism, but in a second phase of operation.

FIG. 4 shows the same mechanism as FIG. 3, but in another configuration in which the obturators 49 and 50 have been unscrewed (51, 52) and are recessed with respect to conduits 47, 48, which are no longer obturated.

The variant of FIG. 5 takes up the arrangements of the embodiment of FIG. 3, except those mentioned hereinafter. The flange 13 is no longer fixed directly to the casing 12, but is now fixed on the fixed body 58 of a hydraulic motor 59. Screws 14*a* fix together the flange 13, the body 58 and the casing 12.

The rotary driven shaft of the motor 59 presents corrugations 60 which mesh with the corrugations 45 previously defined.

The motor 59 furthermore possesses two connections 61, 62 to which are connected conduits 63, 64 connected to a three-way distributor 65. The delivery conduit 66 of a pump 67 itself connected to the tank 55 by its suction conduit 68, and a conduit 69 connecting said distributor to said tank are also connected to said distributor 65.

The three positions of the distributor 65 correspond as follows:

the first position corresponds to the placing in communication of conduits 64 and 66, and of conduits 63 and 69, the second position to the placing in communication of conduits 66 and 69, and to the obturation of conduits 63 and 64, and the third position corresponds to the placing in communication of conduits 66 and 63 and of conduits 64 and 69.

Figure 5:
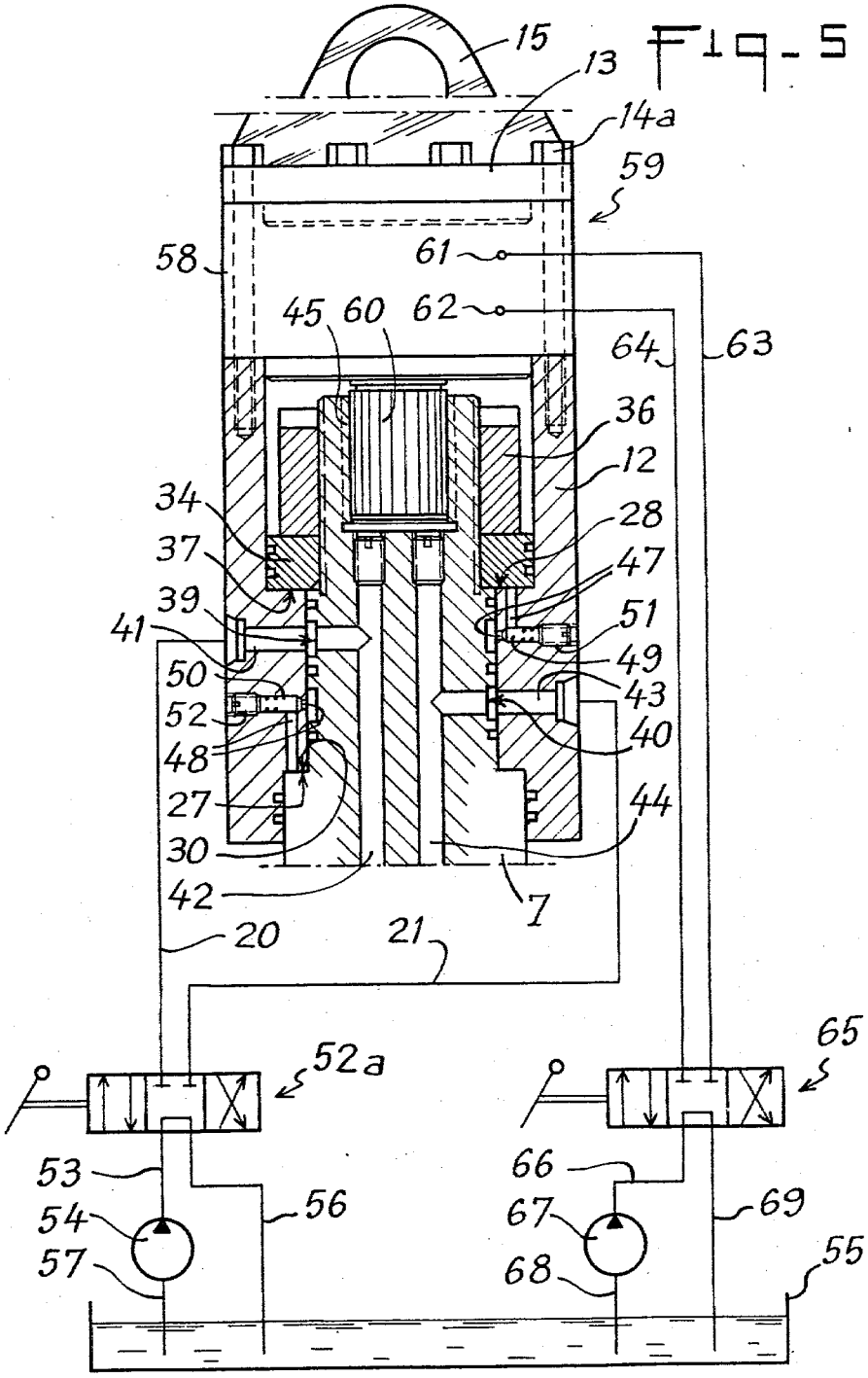
FIG. 5 is an enlarged view similar to that of FIG. 3, of a variant embodiment of the mechanism of FIG. 2.

The arrangements of the obturators 49, 50 are the same in the devices of FIGS. 3 and 5.

Figure 6:
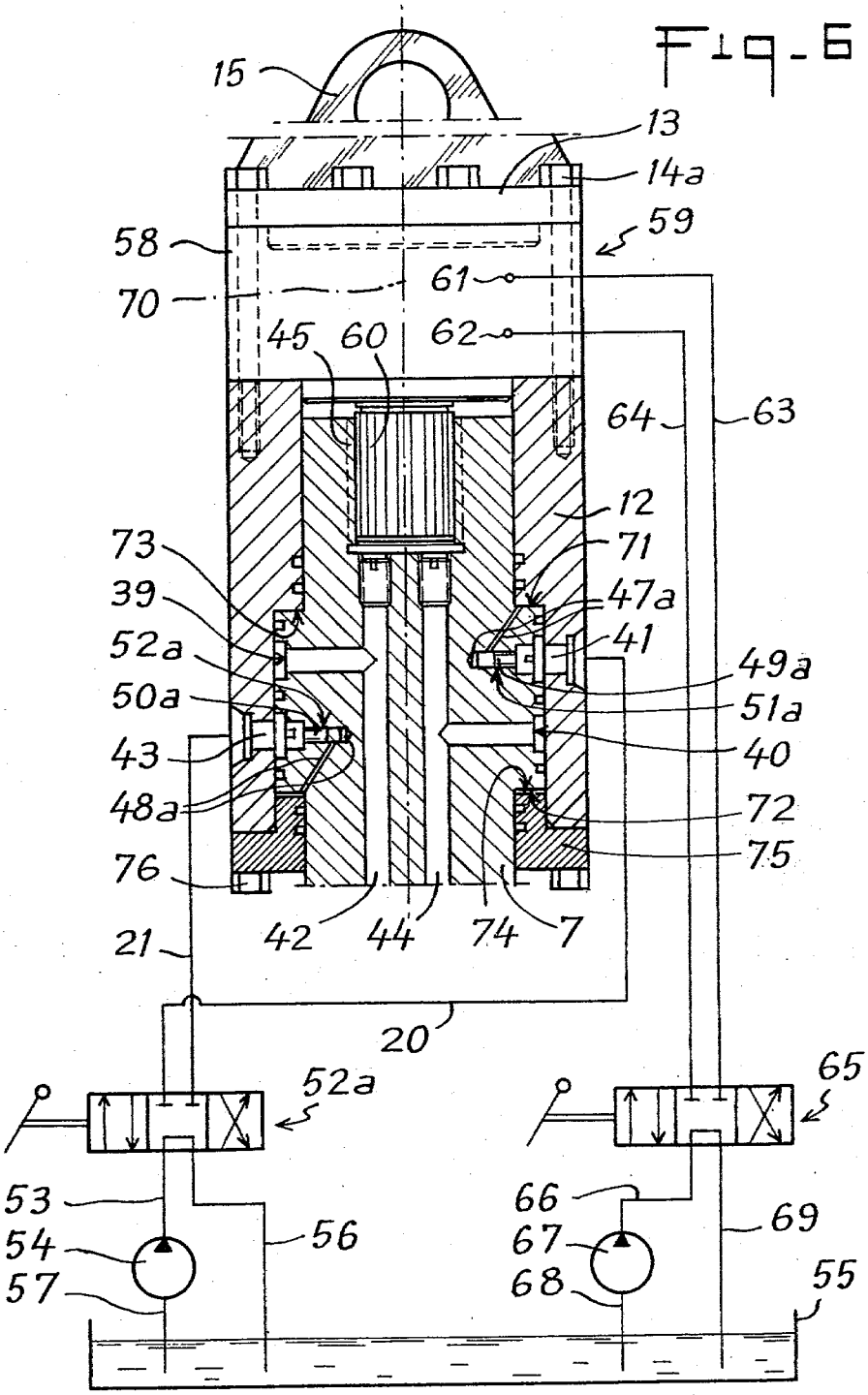
FIG. 6 is an enlarged view similar to that of FIG. 3, of another variant embodiment of the mechanism of FIG. 2.

Finally, the variant embodiment of FIG. 6 is identical to the embodiment of FIG. 5, except concerning the arrangements mentioned hereinafter which, furthermore, could also be adopted in the embodiment of FIG. 3.

In the variant of FIG. 6, it should firstly be noted that if, as in the other embodiments described, the upper piston rod 7 is immobilised in translation with respect to the casing 12, whilst being mounted to rotate in this casing, the assembly means are slightly different. In fact, the various shoulders previously defined are replaced by the following shoulders:

two shoulders 71 and 72 of the upper end of the rod 7, oriented in opposite directions, a shoulder 73 of the casing 12, on which the shoulder 71 of the rod abuts, a shoulder 74 of an end piece 75 screwed (76) on the lower end of the casing 12, shoulder 74 in abutment on the shoulder 72 of rod 7.

Furthermore, the conduits 47 and 48 of the obturators 49 and 50 of the previously described embodiments are replaced respectively by:

a conduit 47*a* which, drilled in the upper piston rod 7, connects the groove 39 to the shoulder 71 into which it opens, a conduit 48*a* which, likewise drilled in the upper piston rod 7, connects the groove 40 to the shoulder 72, into which it opens, an obturator 49*a* which is screwed (51*a*) in the conduit 47*a* itself, an obturator 50*a* which is screwed (52*a*) in the conduit 48*a* itself.

The obturators 49*a* and 50*a* must be accessible from outside the jack to avoid said jack having to be dismantled when said obturators are adjusted. This is made possible by aligning, at the moment of adjusting the position of these obturators 49*a* and 50*a*, the corresponding portion of the conduit 47*a*, 48*a* which is perpendicular to the axis 70 of the jack 5 with the conduits 41, 43 made in the wall of the casing 12.

Figure 7:
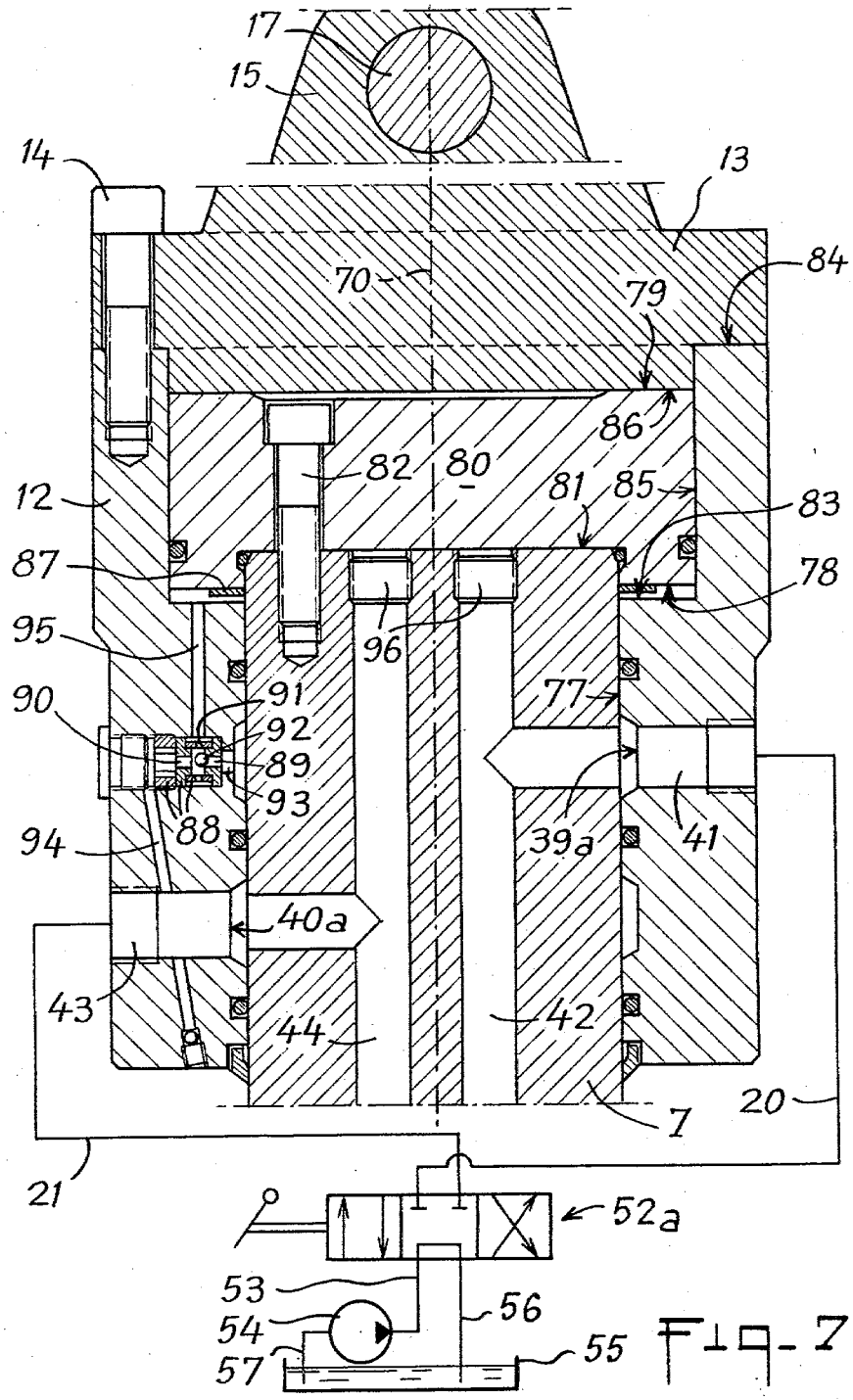
FIG. 7 is an enlarged view similar to that of FIG. 3, of an embodiment according to the invention.

The embodiment of FIG. 7 comprises elements which have already been defined: piston rod 7, casing 12, flange 13, screw 14, fork joint 15, horizontal spindle 17, outer conduits 20 and 21, inner conduits 42 and 44 made in the rod 7, inner conduits 41 and 43 made in the wall of the casing, three-way distributor 52*a*, pump 54, tank 55, conduits 53, 56, 57.

On the contrary, certain arrangements are different. Thus, the conduits 41 and 43 open out into circular grooves 39*a* and 40*a* respectively, which are made on the periphery of the inner cylindrical face 77 of the casing 12. The conduits 42 and 44 open out permanently into said grooves 39*a* and 40*a*, respectively.

The maintenance of the piston rod 7 in axial position with respect to the casing 12 is ensured by two pairs of special shoulders. The shoulders fast with the piston rod 7 are constituted by the two transverse faces 78, 79 of a flange 80, which is distinct from the rod 7 and which is fixed on the end transverse face 81 of this rod 7 by screws 82. The faces 78 and 79 are disposed respectively opposite a shoulder 83 made in the inner face of the body 12, which, from this shoulder 83 to its end 84 for abutment of the flange 13, enlarges into a cylinder 85 and opposite the inner transverse face 86 of this flange 13, respectively, this face 86 constituting the second shoulder fast with the body 12. It should be noted that a wear washer 87 is disposed between the face 78 of the flange 80 and the shoulder 83 of the body 12. When the weights of the piston rod 7, the jack cylinder and tool or tools fixed thereto act alone, the washer 87 is in abutment on the shoulder 83.

Finally, a shuttle valve is mounted in the wall of the casing 12 and is constituted by the actual body 88 of the valve, provided with two inlet connections 89 and 90 and an outlet connection 91, and by an inner ball 92. Three inner conduits, also made in the wall of the body 12, connect said inlet and outlet connections to particular elements: the first conduit 93 connects the inlet connection 89 to the groove 39*a* (and via this groove to conduit 41), the second conduit 94 connects the inlet connection 90 to the conduit 43, and the third conduit 95 connects the outlet connection 91 to the shoulder 83, into which this conduit 95 opens.

Naturally, in all the embodiments, the portions of the conduits 42 and 44 parallel to the axis 70 of the rod are generally pierced by drilling from one end of the rod (face 81 of FIG. 7), for reasons of easier machining. The outer orifice of each conduit is then obturated, in known manner, by a screwed stopper 96.

The operation of the assemblies which have just been described will now be set forth.

Firstly, concerning the embodiment of FIGS. 1 to 4, it may be observed that, in known manner, the positioning of the distributor 52*a* in one of its first and third positions places one of conduits 20, 21 in communication with the fluid under pressure delivered by the pump 54, and places the other conduit (21, 20) in communication with the tank 55. Thus, by means of conduits 20, 41, the groove 39 and conduit 42, and by means of conduits 21, 43, the groove 40 and the conduit 44, respectively, the chambers 23, 24 of the jack 5 are selectively supplied with pressurized fluid and connected to the tank 55, respectively. The cylinder 6 rises or descends with respect to piston 22, according to whether the chamber containing the pressurised fluid is the chamber 23 or 24, and drives the arms 10 which, themselves, cause the shells 2 of the drag bucket to pivot in one direction or the other.

When the conduits 47 and 48 are obturated by obturators 49 and 50 (FIG. 3), neither of grooves 39, 40 communicates with the shoulders 28, 27, with the result that the pressurised fluid contained in one of these grooves does not arrive at the corresponding shoulder, and does not provoke any locking in rotation of the piston rod 7 with respect to the casing 12. Thus, the assembly of the jack 5 (piston rods 7 and 8, piston 22 and cylinder 6) and of the shells 2 which are coupled thereto may rotate freely with respect to the casing 12, itself suspended from the balance beam 1 via spindles 17 and 18.

On the contrary, when the conduits 47 and 48 are no longer obturated (FIG. 4), the pressurised fluid which may be contained in one of the grooves 39, 40 upon, for example, either the complete closure of the shells 2, or on the contrary upon complete opening of these shells, arrives at one of the shoulders 28, 27 and either locks shoulder 27 in abutment on shoulder 30, or shoulder 28 on the face 37 of the ring 34. By this means, the assembly of the jack 5 and of the shells 2 is locked in rotation with respect to the casing 12 and therefore with respect to the balance beam 1.

By way of indication, the following ratio will be noted between the braking torque, then the locking torque of the rotation C expressed in meters x kilogram-weight and the pressure of the fluid P in one of the two grooves 39, 40, expressed in bars:

$$C = 1.05\ P$$

In the device tested, the coefficient of friction between shoulders in abutment was equal to 0.15, the maximum pressure could reach 300 bars, said value having for its effect to obtain the desired locking of the rotation.

This locking is further obtained only when one of the grooves 39, 40 contains a fluid under pressure, and is obtained simply and automatically. It is therefore question of a monitored rotation.

This arrangement does not exclude the possible adoption of a rotation controlled by a motor 59 (FIGS. 5 and 6) effected in known manner.

Finally, with motor controlling the rotation (FIG. 6) or without control motor, the monitoring of the rotation by selective locking may be effected by adopting, as a variant, the arrangements of FIG. 6: conduits 47*a*, 48*a*, obturators 49*a*, 50*a*.

The functioning of the selective locking of the rotation already set forth is identical in the embodiment of FIG. 6. This latter arrangement, which avoids haaving to drill the conduits 47, 48 in the wall of the casing 12, enables a casing to be adopted which comprises relatively thin walls, which may present advantages.

The embodiment of FIG. 7 may be preferred, which is advantageous by its simplicity and efficiency. In this embodiment, as soon as a pressurised fluid is contained in one of the grooves 39*a*, 40*a*, the fluid contained in these two grooves whose pressure is higher arrives in conduit 95 via the shuttle valve (ball 92) and the corresponding conduit 93 or 94. The effect of the pressure of this fluid on the face 78 of the flange 80 is to cause the face 79 of this flange to abut firmly on the face 86 of the flange 13. The automatic locking of the rotation of the rod 7 with respect to the body 12 is thus obtained.

The simplicity of this embodiment must be noted: body 12, whose inner cylindrical face comprises only two diameters (faces 77 and 85) and is easy to machine; shoulders 78 and 79 fast with the rod 7, connected to this rod which, itself, remains unchanged; automatic working of the locking by means of a single shuttle valve as soon as one or the other of the chambers of the jack contains a fluid under pressure.

What is claimed is:

1. A device for controlling the operation of a tool member by pressurized fluid comprising:

a body having at least first and second shoulders and two main conduits adapted to be selectively supplied with said pressurized fluid;

a rotary member adapted to rotate with respect to said body and having first and second shoulders disposed in opposing relation to said first and second shoulders, respectively, of said body for maintaining said rotary member in an axial position with respect to said body, said rotary member including two inner pipes for conveying said pressurized fluid to control the tool member;

two circular grooves disposed between the rotary member and the body, with at least one of said inner pipes and one of said main conduits opening into one of the two circular grooves, and the other main conduit opening into the other circular groove;

a shuttle valve having two inlet connections and an outlet connection; and an inner conduit disposed in one of said body and rotary member and including a first portion which connects a first of the two main conduits to a first of the two inlet connections of the shuttle valve, a second portion which connects the second of the main conduits to the second of the two inlet connections of said shuttle value, and a third portion which connects said first shoulder of said one of said body and rotary member in which said inner conduit is disposed to the outlet connection of the shuttle valve, wherein the pressure of the fluid which is selectively supplied to one of said main conduits is adapted to produce a resultant force on said first shoulder of the other of said body and rotary member for causing said second shoulders of said body and rotary member to firmly abut against each other to lock these latter shoulders and consequently, said rotary member and said body, for preventing relative rotation therebetween.

2. The device of claim 1, wherein the two shoulders of the rotary member are constituted by two faces of a flange which is removably fixed to one end of the rotary member.

3. The device of claim 2, wherein one of the two faces of the flange is in contact with one of the transverse end faces of the rotary member.

4. The device of claim 2, wherein one of the shoulders of the body is constituted by an inner face of an end piece which is removably fixed to said body.

5. A device for controlling the operation of a tool member by pressurized fluid comprising:

a body having at least first and second shoulders and a main supply conduit;

a rotary member adapted to rotate with respect to said body and having first and second shoulders disposed in opposing relation to said first and second shoulders, respectively, of said body for maintaining said rotary member in an axial position with respect to said body, said rotary member including at least one inner pipe for conveying said pressurized fluid to control the tool member;

a circular groove disposed between the rotary member and the body and into which said main supply conduit and said at least one inner pipe open;

an inner conduit disposed in one of said body and rotary member and which opens into the first shoulder of said one of said body and rotary member in which said inner conduit is disposed and which is connected to said main supply conduit, wherein the pressure of the fluid within the main supply conduit is adapted to produce a resultant force on said first shoulder of the other of said body and rotary member for causing said second shoulders of said body and rotary member to firmly abut against each other to lock these latter shoulders and consequently, said rotary member and said body, for preventing relative rotation therebetween; and at least one selective obturation member disposed in the inner conduit for controlling the pressurized fluid in the inner conduit to selectively permit rotation of said rotary member relative to said body or to prevent such rotation, during operation of said device.

6. The device of claim 5, wherein said obturation member is mounted in the body.

7. The device of claim 5, wherein said obturation member is mounted in the rotary member.

8. A device for controlling the operation of a tool member by pressurized fluid comprising:

a body having at least first and second shoulders and a main supply conduit;

a rotary member adapted to rotate with respect to said body and having first and second shoulders disposed in opposing relation to said first and second shoulders, respectively, of said body for maintaining said rotary member in an axial position with respect to said body and including at least one inner pipe for conveying said pressurized fluid to control the tool member;

a circular groove disposed between the rotary member and the body and into which said main supply conduit and said at least one inner pipe open;

an inner conduit disposed in said body and which opens into the first shoulder of said body and is connected to said main supply conduit, wherein the pressure of the fluid within the main supply conduit is adapted to produce a resultant force on said first shoulder of said rotary member for causing said second shoulders of said body and rotary member to firmly abut against each other to lock these latter shoulders and consequently, said rotary member and said body, for preventing relative rotation therebetween; and at least one selective obturation member retractably disposed in the inner conduit.

9. A device for controlling the operation of a tool member by pressurized fluid comprising:

a body having at least first and second shoulders and a main supply conduit;

a rotary member adapted to rotate with respect to said body and having first and second shoulders disposed in opposing relation to said first and second shoulders, respectively, of said body for maintaining said rotary member in an axial position with respect to said body and including at least one inner pipe for conveying said pressurized fluid to control the tool member;

a circular groove disposed between the rotary member and the body and into which said main supply conduit and said at least one inner pipe open;

an inner conduit disposed in said rotary member and which opens into the first shoulder of said rotary member and is connected to said main supply conduit, wherein the pressure of the fluid within the main supply conduit is adapted to produce a resultant force on said first shoulder of said body for causing said second shoulders of said body and rotary member to firmly abut against each other to lock these latter shoulders and consequently, said rotary member and said body, for preventing relative rotation therebetween; and at least one selective obturation member retractably disposed in the inner conduit.

10. A device for controlling the operation of a tool member by pressurized fluid comprising:

a body having at least first and second shoulders and a main supply conduit;

a rotary member adapted to rotate with respect to said body and having first and second shoulders disposed in opposing relation to said first and second shoulders, respectively, of said body for maintaining said rotary member in an axial position with respect to said body and including at least one inner pipe for conveying said pressurized fluid to control the tool member;

a circular groove disposed between the rotary member and the body and into which said main supply conduit and said at least one inner pipe open;

an inner conduit disposed in said body and which opens into the first shoulder of said body and is connected to said main supply conduit, wherein the pressure of the fluid within the main supply conduit is adapted to produce a resultant force on said first shoulder of said rotary member for causing said second shoulders of said body and rotary member to firmly abut against each other to lock these latter shoulders and consequently, said rotary member and said body, for preventing relative rotation therebetween; and at least one selective obturation member removably disposed in the inner conduit.

11. A device for controlling the operation of a tool member by pressurized fluid comprising:

a body having at least first and second shoulders and a main supply conduit;

a rotary member adapted to rotate with respect to said body and having first and second shoulders disposed in opposing relation to said first and second shoulders, respectively, of said body for maintaining said rotary member in an axial position with respect to said body, and including at least one inner pipe for conveying said pressurized fluid to control the tool member;

a circular groove disposed between the rotary member and the body and into which said main supply conduit and said at least one inner pipe open;

an inner conduit disposed in said rotary member and which opens into the first shoulder of said rotary member and is connected to said main supply conduit, wherein the pressure of the fluid within the main supply conduit is adapted to produce a resultant force on said first shoulder of said body for causing said second shoulders of said body and rotary member to firmly abut against each other to lock these latter shoulders and consequently, said rotary member and said body, for preventing relative rotation therebetween; and at least one selective obturation member removably disposed in the inner conduit.

* * * * *